US009179744B2

(12) United States Patent
Takani et al.

(10) Patent No.: US 9,179,744 B2
(45) Date of Patent: Nov. 10, 2015

(54) FASTENER AND ARTICLE PROVIDED WITH FASTENER

(75) Inventors: Go Takani, Toyama (JP); Eiji Nakayama, Toyama (JP); Mitsuo Tsuzuyama, Toyama (JP)

(73) Assignee: YKK Corporation (JP)

( * ) Notice: Subject to any disclaimer, the term of this patent is extended or adjusted under 35 U.S.C. 154(b) by 66 days.

(21) Appl. No.: 13/824,480

(22) PCT Filed: Oct. 29, 2010

(86) PCT No.: PCT/JP2010/069373

§ 371 (c)(1),
(2), (4) Date: Mar. 18, 2013

(87) PCT Pub. No.: WO2012/056583

PCT Pub. Date: May 3, 2012

(65) Prior Publication Data

US 2013/0180088 A1 Jul. 18, 2013

(51) Int. Cl.

| | |
|---|---|
| ***A44B 19/26*** | (2006.01) |
| ***A44B 19/34*** | (2006.01) |
| ***A45C 13/10*** | (2006.01) |
| ***A44B 19/42*** | (2006.01) |
| ***A45C 3/00*** | (2006.01) |

(52) U.S. Cl.

CPC ..... *A44B 19/26* (2013.01); *A44B 19/34* (2013.01); *A44B 19/42* (2013.01); *A45C 3/001* (2013.01); *A45C 13/103* (2013.01); *A45C 13/1092* (2013.01); *Y10T 24/25* (2015.01); *Y10T 24/2561* (2015.01)

(58) Field of Classification Search

CPC ..... A44B 19/26; A44B 19/34; A44B 19/343; A44B 19/346; A44B 19/42; A45C 13/103; A45C 13/1092; A45C 3/001; Y10T 24/25; Y10T 24/2561

USPC ..... 24/381, 389, 391, 401, 403

See application file for complete search history.

(56) References Cited

U.S. PATENT DOCUMENTS

| | | | | |
|---|---|---|---|---|
| 2,144,591 | A * | 1/1939 | Bux et al. | 156/294 |
| 4,276,680 | A * | 7/1981 | Moertel | 24/414 |
| 4,402,115 | A * | 9/1983 | Moertel | 24/410 |
| 5,985,438 | A * | 11/1999 | Watanabe | 428/343 |

(Continued)

FOREIGN PATENT DOCUMENTS

| | | |
|---|---|---|
| CN | 101291993 A | 10/2008 |
| JP | 59-21208 | 2/1984 |

(Continued)

OTHER PUBLICATIONS

International Search Report, PCT Application No. PCT/JP2010/069373, maiied Feb. 1, 2011.

(Continued)

*Primary Examiner* — Robert J Sandy
*Assistant Examiner* — David Upchurch
(74) *Attorney, Agent, or Firm* — Kilpatrick Townsend & Stockton LLP

(57) ABSTRACT

Provided is a fastener that can be recycled as paper. The fastener includes a tape member and an engaging element attached to the tape member, and the total weight of the cellulose fibers included in the tape member and the engaging element is 51 to 100 wt % of the total weight of the tape member and the engaging element.

10 Claims, 6 Drawing Sheets

(56) References Cited

U.S. PATENT DOCUMENTS

| | | | | |
|---|---|---|---|---|
| 6,105,214 | A * | 8/2000 | Press | 24/389 |
| 6,230,373 | B1 * | 5/2001 | Wakai et al. | 24/381 |
| 6,811,862 | B2 * | 11/2004 | Yoshihara et al. | 428/297.4 |
| 2009/0320249 | A1 | 12/2009 | Yoneshima et al. | |

FOREIGN PATENT DOCUMENTS

| | | | |
|---|---|---|---|
| JP | 4-56008 | U | 5/1992 |
| JP | 10-243805 | A | 9/1998 |
| JP | 11-181261 | A | 7/1999 |
| JP | 2005-646 | A | 1/2005 |
| JP | 2005-160667 | A | 6/2005 |
| JP | 2010-12246 | A | 1/2010 |

OTHER PUBLICATIONS

Office Action, Japanese Patent Application No. 2012-540636, mailed Jan. 7, 2014.

* cited by examiner

FASTENER AND ARTICLE PROVIDED WITH FASTENER

TECHNICAL FIELD

The subject invention relates to a fastener, in particular to a slide fastener and a snap fastener. The subject invention additionally relates to an article having such a fastener.

BACKGROUND ART

In response to recent worldwide rising of environmental awareness, eco-friendly products have been demanded in a field of accessories such as clothes and bags. For example, growing needs are observed for products that are free of petroleum resins. From past, paper existing in our living environments has been an appropriate material for recycling, and recently paper made clothes and paper made bags have been available in a market.

On the other hand, almost no paper fastener has existed in the world so far. Research conducted by the subject inventors has merely revealed Japanese Utility Model Application Laid-Open No. 59-21208 (Patent document 1) which discloses a fastener using paper as an ingredient component.

This document discloses a slide fastener where fastener elements are sewn to a paper or nonwoven tape where a film of a thermoplastic synthetic resin is adhered to one surface of that tape. No explanation is given to a material of the elements.

CITATION LIST

Patent Literature

[PTL 1] Japanese Utility Model Application Laid-open No. 59-21208

SUMMARY OF INVENTION

Technical Problem

In order to facilitate the recycling of paper articles such as the paper clothes and the paper bags and so on, it may be beneficial to produce fasteners made of paper either which are to be attached to such articles. However, conventional fasteners are not made of paper, and therefore it has been hesitated to attach conventional fasteners thereto when considering the recycling of the paper articles as paper. Even provided that those fasteners are attached thereto, removing those fasteners on purpose is required after the end of the life of the articles in order for the recycling as paper.

Patent document 1 discloses a slide fastener where its tape is made of paper, however is silent to a technical solution for such a problem. Accordingly, an object of the subject invention may be to provide recyclable and paper containing fasteners. Further, another object of the subject invention may be to provide an article having such a fastener.

Solution to Problem

The subject invention, in its one aspect, concerns a fastener including a tape member and an engaging element attached to said tape member where a total weight of a cellulose fiber included in said tape member and said engaging element is 51 to 100% by weight per the total weight of said tape member and said engaging element.

In one embodiment of the fastener of the subject invention, said tape member is formed by weaving or knitting paper yarns including 80% by weight of the cellulose fiber, and said engaging element is an injection molded product that includes 25 to 100% by weight of the cellulose fiber, 0 to 75% by weight of a polyolefin, and 0 to 30% by weight of starch where the total weight of these three ingredients is equal to or greater than 90% by weight per the weight of said engaging element.

In another embodiment of the fastener of the subject invention, said engaging element includes no starch and is an injection molded product that includes 35 to 70% by weight of the cellulose fiber, and 30 to 65% by weight of the polyolefin.

In yet another embodiment of the fastener of the subject invention, said engaging element includes no polyolefin and is an injection molded product that includes 70 to 90% by weight of the cellulose fiber and 10 to 30% by weight of the starch.

In yet another embodiment of the fastener of the subject invention, said fastener is a slide fastener comprising a slider that is an injection molded product that includes 25 to 100% by weight of the cellulose fiber, 0 to 75% by weight of a polyolefin, and 0 to 30% by weight of starch where the total weight of these three ingredients is equal to or greater than 90% by weight per the weight of said slider.

In still another embodiment of the fastener of the subject invention, said fastener is a slide fastener comprising a slider, said engaging element is an injection molded product that includes no starch, 35 to 70% by weight of the cellulose fiber, and 30 to 65% by weight of the polyolefin where the total weight of the cellulose fiber and the polyolefin is equal to or greater than 90% by weight per the weight of said engaging element, and said slider is an injection molded product of the same composition with said engaging element.

In still another embodiment of the fastener of the subject invention, said fastener is a slide fastener comprising a slider, said engaging element is an injection molded product that includes no starch, 35 to 70% by weight of the cellulose fiber, and 30 to 65% by weight of the polyolefin where the total weight of the cellulose fiber and the polyolefin is equal to or greater than 90% by weight per the weight of said engaging element, and said slider is an injection molded product of different composition than said engaging element.

In still another embodiment of the fastener of the subject invention, the total weight of the cellulose fiber included in said tape member, said engaging element and said slider is equal to or greater than 51% by weight per the total weight of said tape member, said engaging element and said slider.

In still another embodiment of the fastener of the subject invention, the total weight of the cellulose fiber included in all components of said fastener is equal to or greater than 51% by weight per the total weight of said components of said fastener.

Another aspect of the subject invention provides an article comprising said fastener of the subject invention.

Advantageous Effects of Invention

A Paper fastener is provided which is environmentally friendly and recyclable as paper in accordance with the subject invention.

DESCRIPTION OF EMBODIMENTS

Figure 1:
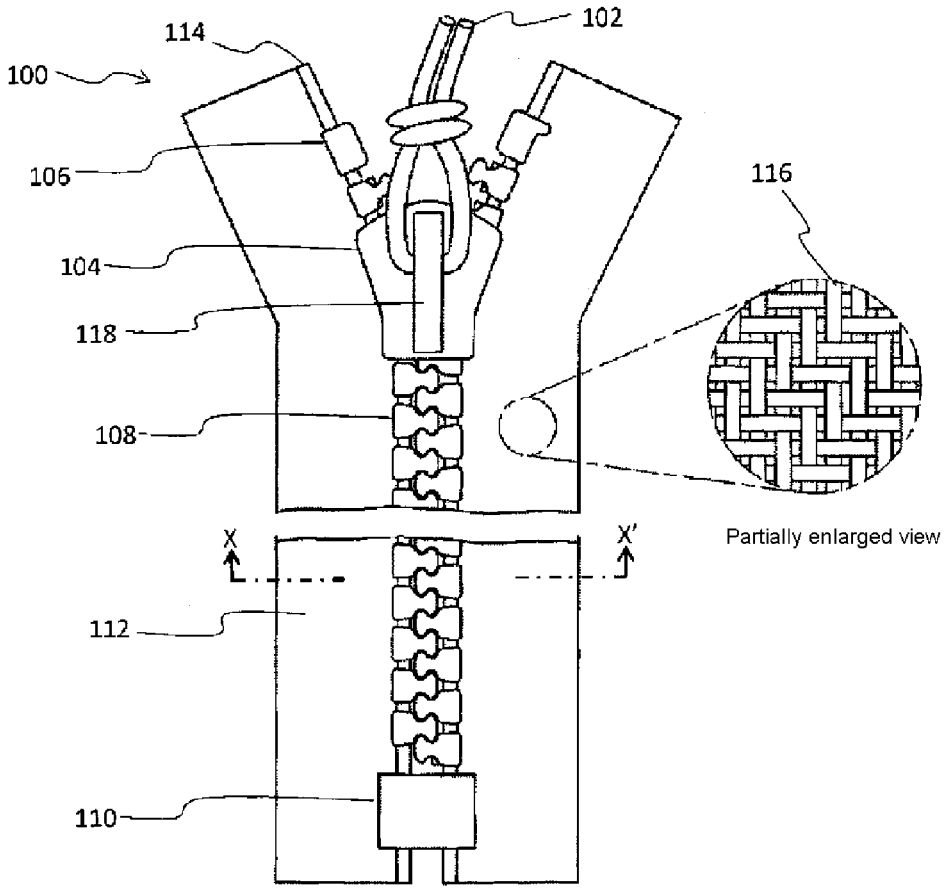
FIG. 1 is a front view of a slide fastener according to a first embodiment of the subject invention.

Hereinafter, embodiments of the subject invention will be explained in detail with references to the drawings.

The subject invention involves an arbitrary configurable fastener comprising a tape member and an engaging element attached to the tape member by an injection molding process, namely a slide fastener and a snap fastener, not limited to a particularly configured fastener though. In a case of a slide fastener, a pair of elongated tapes corresponds to said tape member, and a number of elements of biting portions attached along one side edge of the respective tapes correspond to said engaging element. Further, a slide fastener normally comprises a slider that controls opening and closing operations of the fastener by engaging and disengaging the elements. In a case of a snap fastener, male and female members correspond to the engaging element, and fastener tapes to which the male member and the female member are respectively attached correspond to the tape member.

In order to conduct the recycling, as paper, of the fasteners having the tape member and the engaging element, it may be preferable that a total weight of a cellulose fiber contained in the tape member and the engaging element is equal to or greater than 51% by weight, preferably equal to or greater than 60% by weight, per the total weight of the tape member and the engaging element. Therefore, the ingredient composition composing the tape member and the engaging element may be preferably selected in light of this point. For example, a demand for strength may be greater for the engaging element than the tape member, as stress and friction with the slider and an outside are applied thereto during its use. In a preferred embodiment of the subject invention, in order to have greater strength than the tape member, while using a material including a polyolefin and/or starch for the engaging element, it may be considered to control a content of the cellulose fiber with respect to the total weight of the tape member and the engaging element to secure the recyclability thereof.

Firstly, based on such a perspective, an embodiment of a tape member according to the subject invention will be explained. A tape member is a member which is for fixing the engaging element and which is to be coupled to a main body of an article through sewing, pasting, an adhesive other than a paste and so on. Pasting may be preferable in order for the coupling to the main body of the article from a view point of the recycling of paper. Here, the paste may indicate an adhesive that is mainly composed of starch that is produced from farinaceous materials such as rice, wheat starch and so on. The tape member may be composed of paper having a predetermined ingredient composition in the subject invention.

The tape member of the subject invention, in an embodiment, may be composed of general paper materials produced through agglutination of vegetable fibers. Paper making processes are well-known and it is possible to produce paper, for example, through a pulp process for obtaining wood or wood-free pulp obtained from wood, cotton, flax, hemp, straw, oriental paper-bush (Mitsumata), paper mulberry (Kouzo) and so on, or used paper pulp such as paper of used newspapers, magazines, corrugated boards and so on, boards, cut scrap paper, torn paper caused through a papermaking process, broken paper, lavatory paper, an used refuse paper and so on; and a paper making process for forming an uniform sheet from pulp diffused in a water and for drying it. In the explanations below, "paper ingredient" and "cellulose fiber" may be used interchangeably.

Cellulose fibers inside of paper composing a tape member may be essential for enabling the recycling of paper. When its content is too low, recyclability may be therefore degraded. For this reason, it may be preferable to have cellulose fibers equal to or greater than 80% by weight and more preferably equal to or greater than 90% by weight. In this case, it may be possible to add starch to the remaining. It may be further preferable to have cellulose fibers equal to or greater than 100% by weight.

Paper having the above described ingredient composition may be utilized for the tape member without further processing. However, from a stand point of the strength and endurance, it may be preferable to produce by slitting the above described paper to be a narrow width paper member using a slitter, twisting the obtained narrow width paper members to form a yarn (hereinafter referred as "a paper yarn"), and forming a sheet by knitting or weaving it. In a case of a paper yarn composed of a Manila hemp, for example, it is possible to produce it through a fiber-obtaining process for taking out fibers by tearing leaf sheath portions after harvesting the manila hemps; a pulp process for producing pulp after steaming the narrowly slit hemp fibers using a huge boiler; a paper making process for producing paper by allowing pulp go through a paper machine; a slitting process for finely slitting the paper using a slitter; and a twining process by twisting paper members of narrow tape shape to be a thread of the twisted paper members. As paper yarns, for example, a natural paper yarn fiber OJO+ (a registered trademark) may be utilized, for example.

Any know various additives may be added to paper of the tape member of the subject invention, provided that recyclable condition of paper is satisfied. For example, various compounds may be added as needed which may be various types of starch known as an agent for paper making, polyacrylamide, an urea resin, a melamine resin, an epoxy resin, polyamide, polyamine, polyethylene-imine, a plant-derived gum, polyvinyl alcohol, latex, polyethylene oxide, a hydrophile cross-linked polymer particles dispersed material and these derivatives or converted materials and so on. It is also possible to add an internal conditioner for papermaking as needed which may be antioxidant, lubricant, dye, fluorescent bleach, pH adjuster, an antifoaming agent, a pitch control agent, and a slime control agent and so on. Further, it is also possible to add an internal conditioner for papermaking as needed which may be an alkali aluminum compound of aluminum sulfate, aluminium chloride, sodium aluminate, alkali aluminum chloride, alkali poly aluminum hydroxide and so on, or a water-soluble aluminum compound of readily-soluble alumina sol and so on, a polyvalent metal compound of ferrous sulfate, ferric sulfate and so on, silica sol and so on.

Next, an explanation is made for an embodiment of the engaging element. The engaging element functions to engage the respective engaging elements through coupling such as biting, fitting and as such and to separate them by releasing the coupling. Generally the engaging element is attached to the tape member and plural elements are aligned. The engaging element is attached to the tape member typically by an injection molding.

The engaging element of the subject invention, in one embodiment, may be introduced in a form of an injection molded product that contains a cellulose fiber, a polyolefin series resin, and starch. As the polyolefin series resin, a material that is suitable for an injection molding after mixing its pellet material with paper may be preferable, for example polyethylene and polypropylene may be named. The polyolefin with different materials being mixed could be adoptable.

In a representative embodiment of an engaging element of the subject invention, the engaging element is an injection molded product that contains 25 to 100% by weight of the cellulose fiber, 0 to 75% by weight of a polyolefin, and 0 to 30% by weight of starch, wherein the total weight of these three ingredients is equal to or greater than 90% by weight per the weight of the engaging element. Cellulose fiber embedded in the engaging element is necessary for enabling the recycling of paper, and thus 25 to 100% by weight has been chosen. The polyolefin and starch are arbitrary ingredients and may be added for enhancing the strength and endurance. The polyolefin is superior to starch from the strength and endurance points, however, it is inferior to starch from an environmental protection standpoint as fossil fuels are used as materials. Therefore, the usage may be determined by balancing these factors. Considering the balance between the recyclability and the strength/endurance, the polyolefin and starch in total may be contained equal to or greater than 10% by weight, preferably equal to or greater than 20% by weight. An acceptable amount of starch may be less than that of the polyolefin, as too much starch being contained may tend to make the engaging element brittle in other way.

In another representative embodiment of an engaging element of the subject invention, the engaging element is an injection molded product that contains 51 to 100% by weight of the cellulose fiber, 0 to 49% by weight of the polyolefin, and 0 to 30% by weight of starch, wherein the total weight of these three ingredients is equal to or greater than 90% by weight per the weight of the engaging element. The subject embodiment presents a blend (composition) where weight is given to a paper recycling attribute of the engaging element. From the strength and endurance points, it is preferable to contain the polyolefin and starch in total equal to or greater than 10% by weight, more preferably equal to or greater than 20% by weight.

In yet another representative embodiment of an engaging element of the subject invention, the engaging element is an injection molded product that contains no starch, 35 to 70% by weight of the cellulose fiber, and 30 to 65% by weight of the polyolefin, wherein the total weight of the cellulose fiber and the polyolefin is equal to or greater than 90% by weight per the weight of the engaging element. The subject embodiment presents a blend that gives weights on the strength and endurance. Considering the balance between the recyclability and the strength/endurance, the cellulose fiber may be 45 to 65% by weight, and the polyolefin may be 35 to 55% by weight.

In yet another representative embodiment of an engaging element of the subject invention, the engaging element is an injection molded product that contains no polyolefin, 70 to 90% by weight of the cellulose fiber, and 10 to 30% by weight of starch, wherein the total weight of the cellulose fiber and starch is equal to or greater than 90% by weight per the weight of the engaging element. The subject embodiment presents a blend that gives weights on the environmental protection. Considering the balance between the recycling attribute and the strength/endurance, the cellulose fiber may be 75 to 85% by weight, and starch may be 15 to 25% by weight.

In the above embodiment, the cellulose fiber, the polyolefin and starch are base of the engaging element of the subject invention, and thus the total weight of these three ingredients may be typically equal to or greater than 90% by weight per the weight of the engaging element, but may be equal to or greater than 95% by weight, and may be 100% by weight.

The engaging element may be produced using known injection molding techniques. In particular, it is possible to produce it by mixing wood or wood-free pulp obtained from wood, cotton, flax, hemp, straw, oriental paper-bush (Mitsumata), and paper mulberry (Kouzo) and so on, or a paper member of an used newspaper, a magazine, a corrugated board and so on, used paper pulp of a paper member, a board, a cut scrap paper, a torn paper caused through papermaking process, a broken paper, a dropped paper, an used refuse paper and so on, or a mixture thereof with a predetermined amount of a pellet material of the polyolefin together while heating in an injection molding machine; and filling the mixture to an injection molding mold. Water may be added in conjunction when starch is contained, and drying process for drying the water after the injection molding (pulp injection molding) may be preferably adoptable.

Any various known additives may be added to the injection molded product configuring the engaging element of the subject invention, provided that the condition of the above blend is satisfied. Additives similar to the examples explained in the tape member section may be employed as additives. Antioxidants and lubricants may be added.

Next, an embodiment of a slider will be explained. In the slide fastener, the slider is a part for opening and closing a slide fastener by engaging and disengaging engaging elements, and it is possible to produce it by a die-casting of zinc and so on, representatively. The slider itself may be easily removable from the fastener, therefore it may be acceptable to make it from a metal and a synthetic resin similar to a conventional manner, but it may be preferable to make it from paper component for enhancing its recyclability. Thus, in an embodiment of the subject invention, the slider may be produced through an injection molding of the similar materials with the materials of the engaging element. The composition of the injection molded product configuring the slider may be identical to the one of the engaging element, and different composition than the engaging element may be adoptable. Different composition may be preferable, as friction resistance between the slider and the engaging element becomes less and sliding attribute improves.

In an example, the slider may be an injection molded product that contains 25 to 100% by weight of the cellulose fiber, 0 to 75% by weight of a polyolefin, and 0 to 30% by weight of starch, wherein the total weight of these three ingredients is equal to or greater than 90% by weight per the weight of the slider. Considering a balance between the recyclability and the strength/endurance, similar to the engaging element, the polyolefin and starch in total may be contained equal to or greater than 10% by weight, preferably equal to or greater than 20% by weight. It should be noted that a slider may be made lacking both of the polyolefin and starch as its ingredients, when the finest focus is put on lowering an environmental load.

In yet another example, a slider may be an injection molded product that contains no starch, 35 to 70% by weight of the cellulose fiber, and 30 to 65% by weight of the polyolefin, wherein the total weight of the cellulose fiber and the polyolefin is equal to or greater than 90% by weight per the weight of the slider. This blend reflects consideration that the strength and endurance are required for a slider of a sliding part. The slider may be producible by known injection molding techniques, similar to the engaging element. A pull tab used for guiding the slider may be made from a material containing a cellulose fiber and a polyolefin, but a twisted thread made by the above paper yarns may be used as making it from paper is preferable.

Materials similar to the tape member or engaging element may be useable for configuring other components of the fastener. For example, a pull tab attached to the slider may be composed of paper of ingredient composition similar to the one described at the tape member section. In a slide fastener, a similar explanation holds true to an upper stop and lower stop for preventing a slider-drop, in addition to a core thread typically provided along a side edge of a longitudinal direction of a tape for securing the attachment strength of an element.

From a viewpoint of the recyclability of the fastener, the total weight of the cellulose fiber contained in the engaging element and slider may be preferably equal to or greater than 51% by weight per the total weight of the tape member, engaging element, and slider, and more preferably equal to or greater than 60% by weight. Further, the total weigh of the cellulose fiber contained in all components of the fastener may be preferably equal to or greater than 51% by weight per the total weight of the components of the fastener (for example, a tape member, an engaging element, a slider, an upper stop, a lower stop, a pull tab and so on), more preferably equal to or greater than 60% by weight.

<First Embodiment of Fastener>

FIG. 1 discloses a front view of a slide fastener 100 according to a first embodiment of the subject invention. The slide fastener 100 is configured by a pair of fastener tapes 112 having core threads 114 of an enlarged shape in a sectional view, a pair of lines of fastener elements 108, a slider 104 having a pull tab attaching portion 118, a pull tab 102, an upper stop 106, and a lower stop 110. The line of the fastener elements 108 is injection-molded onto the core thread 114. In the subject specification, an upward direction is referred as a direction along which the slider slides causing the element lines bite and couple together, and a downward direction is referred as a direction along which the slider slides causing the element lines disengage and separate. It should be noted that respective products where the line of the fastener elements 108 is attached to the fastener tape 112 may be referred as a fastener stringer. Further, a pair of the respective fastener stringer would be referred as a fastener chain. Yet further, a direction horizontal to a surface of the fastener tape and vertical to the up and down direction is referred as a width direction.

As described at a partially enlarged view in FIG. 1, the fastener tape 112 is woven or knitted using paper yarns 116 that is made from paper having the above described ingredient composition according to the subject invention (for example, 100% by weight of cellulose fibers), and the core thread 114 is formed along its side edge of the longitudinal direction. For example, the core thread 114 may be formed by weaving or knitting a bundle of the paper yarns of 100% by weight of the cellulose fibers at the side edge of the fastener tape 112. The fastener element line configured from a plurality of fastener element 108 capable of engaging to bite and disengaging to separate is attached to the core thread 114 by an injection molding process. A fastener element 108 contains 51% by weight of the cellulose fibers and 49% by weight of a polypropylene, for example.

Figure 2:
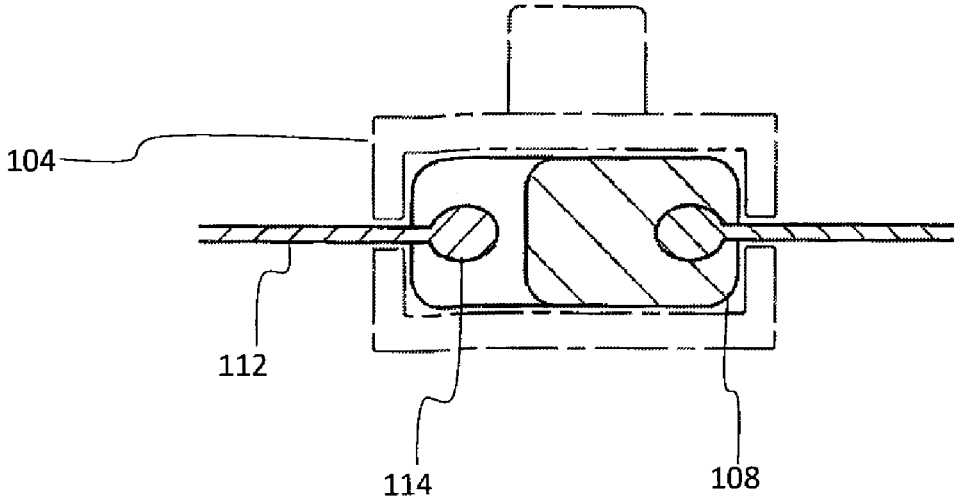
FIG. 2 is a sectional view along a line of X-X' in FIG. 1.

FIG. 2 illustrates a sectional view along a line of X-X' in FIG. 1. The fastener element 108 is formed by an injection molding process to sandwich the entire of the core thread 114 which is formed at the side edge of the fastener tape 112 from front and rear sides. The dotted line 1 indicates an imaginary line of a slider.

The slider 104 slides while allowing the line of the fastener element 108 being inserted thereto, thus achieving engaging to bite and disengaging to separate the pair of fastener element 108. The slider 104, including the pull tab attaching portion 118, is an injection molded product that contains 51% by weight of the cellulose fibers, and 49% by weight of the polypropylene, for example. The upper stop 106 is injection molded such that the core thread 114 is sandwiched from front and rear sides of the fastener tape at a side edge of the fastener tape and at adjacent to the upper end of the line of the fastener element 108. The lower stop 110 is provided at a lower end of the line of the fastener elements 108, and is formed at both of the opposing side edges of the respective fastener stringers to swage and fix them. The upper stop 106 and the lower stop 110 are injection molded products containing 51% by weight of the cellulose fibers and 49% by weight of the polypropylene, for example, similar to the fastener element. Further, the lower stop shown in FIG. 1 is configured not to allow the separation of the lower part of the fastener chain, but a separable retainer may be attached to allow separation of the respective fastener stringers. Further, another piece of slider may be attached in combination to the slider 104 and a separable retainer may be attached for an inverse-opening type where the slider opens the fastener from a lower side of the fastener stringer.

In a fastener stringer per 1 meter according to this first embodiment, a ratio between the fastener tape and the fastener element (engaging element) presents 44% by weight of a fastener tape and 56% by weight of a fastener element. When the fastener element is composed of a material containing 51% by weight of the cellulose fibers and 49% by weight of a polyolefin (polypropylene), as the entire fastener stringer, 73% by weight of the cellulose fibers and 27% by weight of the polyolefin are contained, and thus it is recyclable as paper. Further when a material containing 70% by weight of the cellulose fibers and 30% by weight of the polyolefin (polypropylene) is used for the fastener element in the same fastener tape, the entire fastener stringer, 83% by weight of the cellulose fibers and 17% by weight of the polyolefin are contained, and thus recyclability of paper may be improved. Further, in the same fastener tape, when the fastener element is composed of a material containing 35% by weight of the cellulose fibers, and 65% by weight of the polyolefin (polypropylene), the entire fastener stringer, 64% by weight of the cellulose fibers and 36% by weight of the polyolefin are contained, and thus it is recyclable as paper and may give a fastener element enough strength.

Even the upper stop 106 and lower stop 110 are omit, it is possible to prevent a drop off of the slider 104 by appropriately making the fastener, for example, folding a fastener tape between the upper and down ends of the fastener element line, and then sewing it to an apparel and so on under that attitude.

By using a ring formed by the pull tab attaching portion 118 and the front panel of the slider 104, a rope-like pull tab 102 is attached to the pull tab attaching portion 118 which is laid along an up and down direction on the front panel of the slider 104. This pull tab 102 is made by forming a rope by bundling paper members having the same ingredient composition with the fastener tape 112 and knotting the rope in a circular manner after inserting the rope into the ring portion.

If the slider 104 and the fastener element 108 are composed of exactly the same material, their contact may cause a greater friction when the slider 104 slides, and easier sliding may be deteriorated. Thus, materials different from the fastener element 108 may be adoptable. In such an instance, the material of the slider may be preferably a material containing 51% of the cellulose fibers and 49% of a polyolefin. In this case, the material of the fastener element may be a material containing 45% by weight of the cellulose fibers and 55% by weight of a polyolefin, for example, allowing greater strength than the slider.

<Second Embodiment of Fastener>

Figure 3:
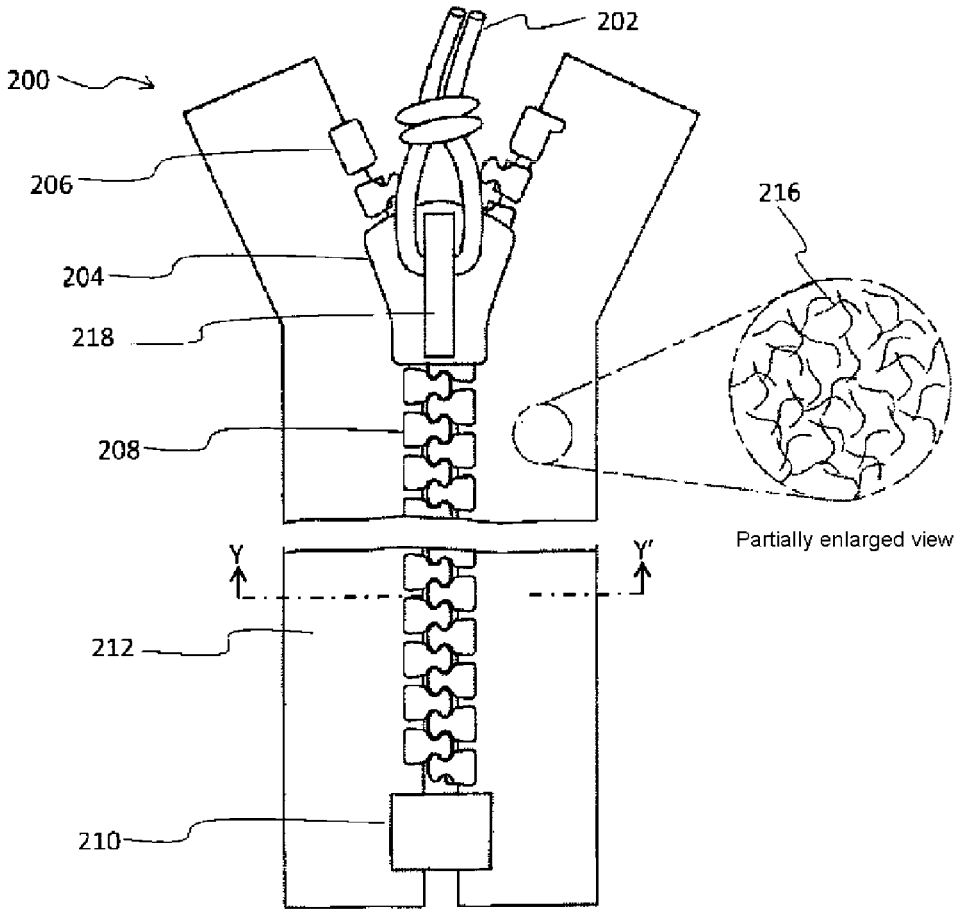
FIG. 3 is a front view of a slide fastener according to a second embodiment of the subject invention.

FIG. 3 illustrates a front view of a slide fastener 200 according to a second embodiment of the subject invention. The slide fastener 200 is configured by a pair of fastener tapes 212, a pair of lines of fastener elements 208 attached along the opposing side edges of the fastener tapes 212, a slider 204 having a pull tab attaching portion 218, a pull tab 202, an upper stop 206, and a lower stop 210.

The fastener tape 212 is made from paper, as it is, containing 100% by weight of the cellulose fibers, for example, and the cellulose fibers 216 of fiber materials are under inter-tangled condition as shown in partially enlarged view in FIG. 3. Thus, the fastener tape of the second embodiment does not have the core thread and formed to be a flat paper, fastener tape of the first embodiment has the expanded core thread 114 in a cross sectional view at the side edge of the fastener tape though. At the side edge of a longitudinal direction of the fastener tape 212, the fastener element line configured from a plurality of fastener elements 108 capable of engaging to bite and disengaging to separate is attached to the fastener tape 212 by a pulp injection molding so as to sandwich the fastener tape 212 from front and rear sides. The fastener element 208 contains 100% by weight of the cellulose fibers, for example, and cellulose fibers exist in inter-tangled condition at the surface. It should be noted that the blend described at this section is an exemplary embodiment and never serve as a limitation. A fastener element containing 60% by weight of the cellulose fibers, 30% by weight of starch, and 10% by weight of a polyvinyl alcohol may be used, for example.

Figure 4:
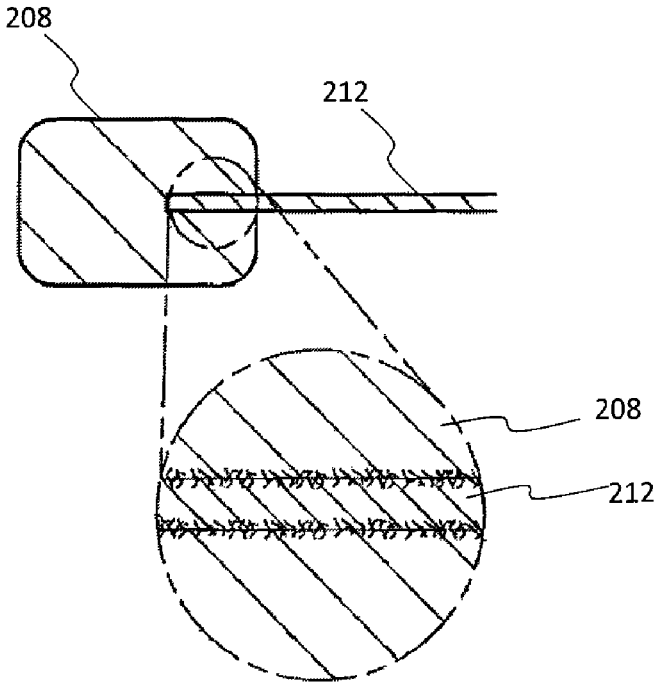
FIG. 4 is a sectional view along a line of Y-Y' in FIG. 3.

FIG. 4 illustrates a sectional view along a line of Y-Y' in FIG. 3. As illustrated at a partially enlarged view in FIG. 4, at an interface between the element 208 and the fastener tape 212, the respective cellulose fibers inter-tangle to cause resistance when pulling. Moreover, the same material are used for the upper stop 206 and the lower stop 210 with the fastener element 208, and thus respective cellulose fibers inter-tangles at the interface between the fastener tape 212 and the upper stop 206/the lower stop 210. The slider 204 may be composed of the same material with the fastener element 208. In this example, the slide fastener 200 as shown in FIG. 3 is entirely composed of the cellulose fibers including the pull tab 202, and thus preferable as environmental load may be reduced.

As the slider 204 contacts the fastener element 208, if both of which are composed of the same materials, greater friction may be caused when the slider 204 slides and easier sliding may be deteriorated. Therefore, a material different from the fastener element 208 may be used, for example, a material mixture of the cellulose fibers and the polyolefin as described in the first embodiment. As a result, the strength of the slider itself improves.

Figure 5:
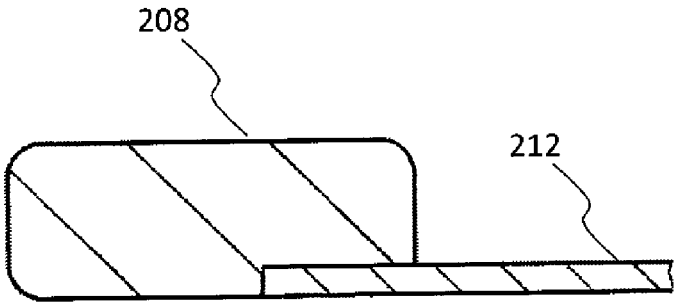
FIG. 5 is a sectional view of a variant example of a second embodiment of the subject invention which corresponds to the line of Y-Y' line in FIG. 3.

FIG. 5 illustrates a sectional view of a slide fastener of a variant example of a second embodiment and which is similar to the sectional view along the line of Y-Y' line in FIG. 3. What are similar to the second embodiment is that the fastener tape 212 is composed of paper containing 100% by weight of the cellulose fibers as it is, for example; the fastener element 208 contains 100% by weight of the cellulose fibers; and cellulose fibers are under inter-tangled condition at the respective surfaces.

In this variant example, at the side edge of a longitudinal direction of the fastener tape 212, the fastener element line configured from a plurality of fastener element 208 capable of engaging to bite and disengaging to separate is attached to the fastener tape 212 by a pulp injection molding at the front surface side (one surface side) of the fastener tape 212. In this variant example, the fastener element 208 is formed at front surface side (one surface side) and edge surface side only of the fastener tape 212, and not formed at the rear surface side (another surface side). Still, at the interface between the fastener element 208 and the fastener tape 212, the respective cellulose fibers inter-tangle to cause resistance against pulling, and thus practical coupling power is obtainable.

<Third Embodiment of Fastener>

Figure 6:
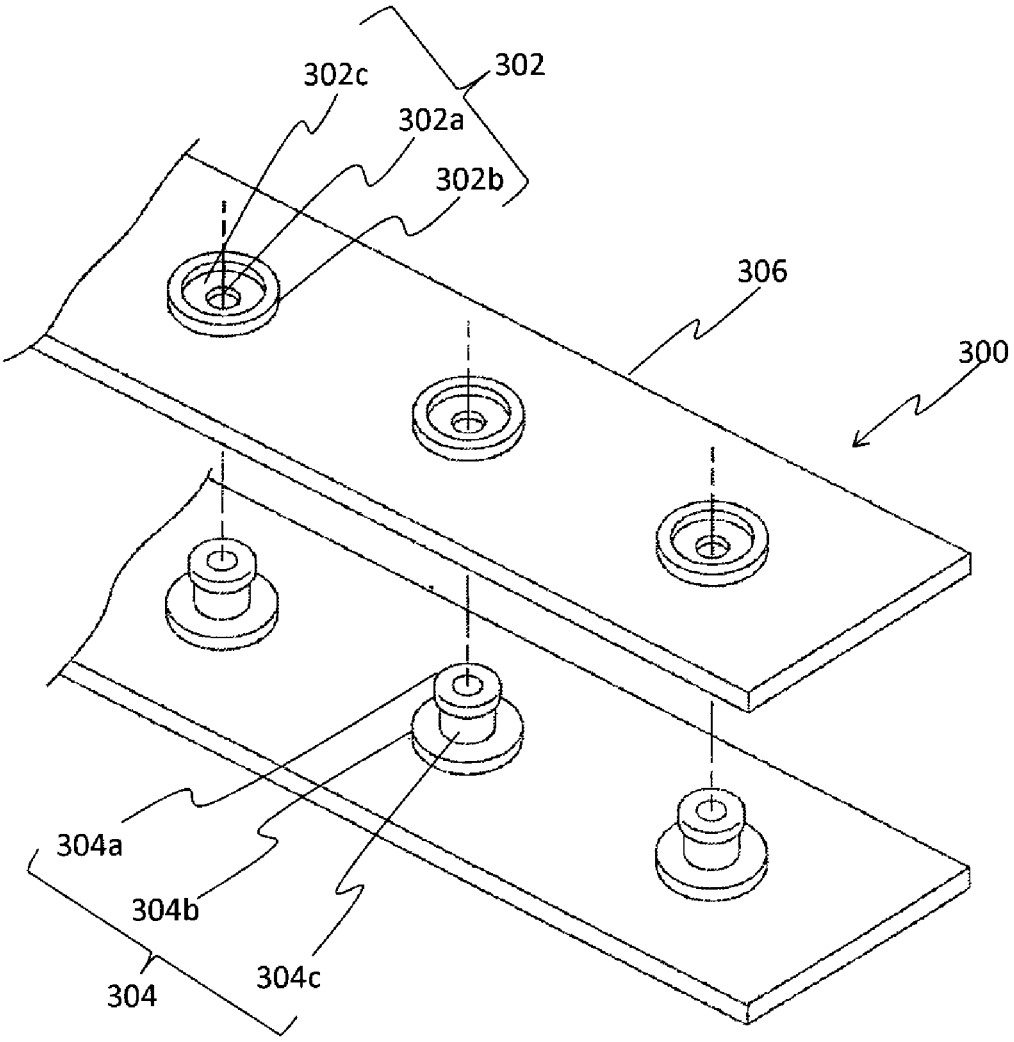
FIG. 6 is a partial perspective view of a snap fastener according to a third embodiment of the subject invention.

FIG. 6 illustrates a perspective view of a snap fastener 300 according to a third embodiment of subject invention. The snap fastener 300 is configured by a pair of front and rear fastener tapes 306, snap elements of an engaging element (male member 304 and female member 302) which are injection molded to the respective fastener tapes 306. The male member 304 has a disk-like base 304*b* positioned on one of the fastener tapes 306, and a co-axial cylindrical neck portion 304*c* formed in a projecting manner onto the base 304*b* and having a smaller diameter than the base 304*b*, and a co-axial disk-like coupling head 304*a* formed at the top of the neck portion 304*c* and having a greater diameter than the neck portion 304*c*. The female member 302 has a disk-like base 302*c* positioned on another of the fastener tapes 306, a wall 302*b* projecting along a circumference of the base 302*c*, and a coupling hole 302*a* engraved at the center of the base 302*c*. The opening and closing operations of the snap fastener is performed by coupling and decoupling of the coupling head 304*a* and the coupling hole 302*a*.

The fastener tape 306 may contain 100% by weight of the cellulose fibers, for example, and may be a fastener tape formed by weaving or knitting the paper yarns described in the first embodiment. Alternatively, the paper described in the second embodiment may be used as a faster tape as it is. The snap element (male member 304 and female member 302) is an injection molded product containing 35 to 70% by weight of the cellulose fibers, and 30 to 65% by weight of the polypropylene, for example. In order to have the snap element 304, 302 being injection molded to the fastener tape 306 made of the paper yarns, the fastener tape 306 is provided between an upper mold and a lower mold for the injection molding, and then material is injected thereto under that condition, resulting that they are injection molded at front and rear sides of the fastener tape 306. The snap element 304, 302 formed at the front and rear sides are coupled between the front and rear sides, running through weaved or knitted texture. Even in a case where the snap element 304, 302 are formed by injection molding techniques onto the fastener tape 306 that is made of paper as it is, the fastener tape 306 is provided between an upper mold and a lower mold for the injection molding, and then a material is injected thereto under that condition, resulting that they are injection molded at front and rear sides of the fastener tape 306. At the interface between the snap elements formed at the front and rear sides, the respective cellulose fibers inter-tangle. In the case of injection molding, cellulose fibers respectively inter-tangle at the interface and are integrated, and thus there is no need to form the snap element 304, 302 across the front and rear sides of the fastener tape 306. Therefore, snap element 304, 302 may be formed only to the opposing side of the snap elements 304, 302 among the front and rear sides of the fastener tape 306, and no need to form them at the opposite sides.

<Application Example to Paper Article>

Figure 7:
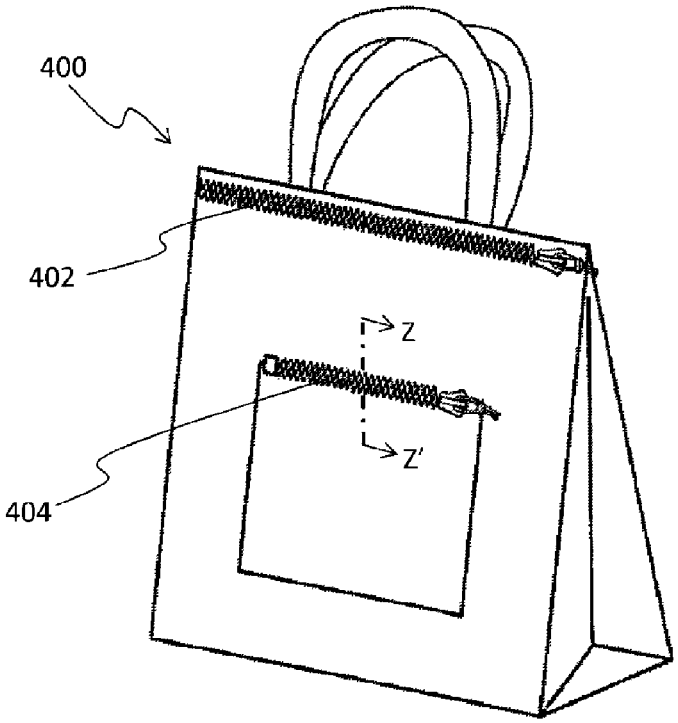
FIG. 7 is an example where a paper slide fastener of the subject invention is attached to an opening and closing section of a paper bag.
Figure 8:
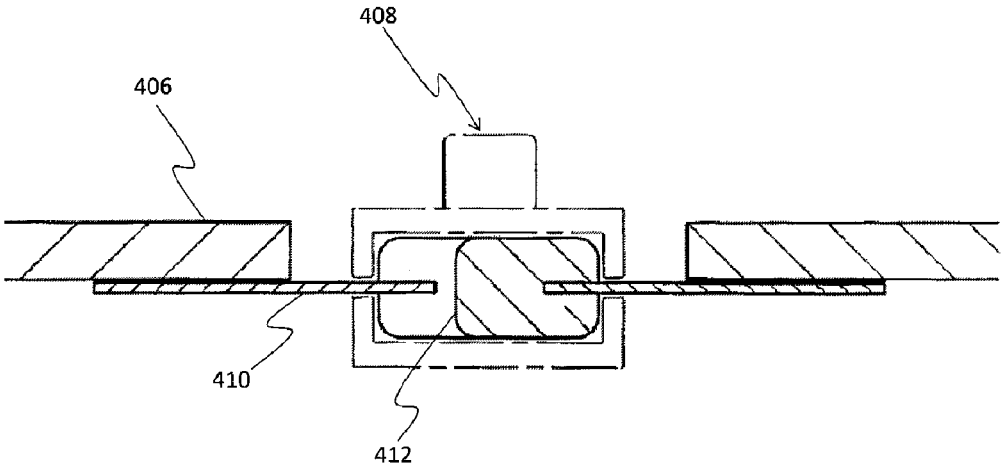
FIG. 8 is a sectional view along a line of Z-Z' in FIG. 7.

FIG. 7 illustrates an example where a paper slide fastener 402, 404 of the subject invention is attached to an opening and closing section of a paper bag 400. FIG. 8 illustrates a sectional view along a line of Z-Z' in FIG. 7. With reference to FIG. 8, fastener elements 412 are attached by a pulp injection molding to one side edge of the respective fastener tapes 410, and a main body 406 of the bag 400 is coupled to another side edge of the respective fastener tape 410 by pasting to a surface portion across the central area. Wider pasting area may be preferable for the purpose of securing adhesive power between the fastener tape 410 and the main body 406 of the bag 40. Therefore, in this example, the fastener tape 410 is sized wider. For example, a fastener tape of a slide fastener used for clothes and so on normally presents about 20 mm, but the wider faster tape 41 presents 1.5 to 2 times wider, that is 30 mm to 40 mm preferably. The dotted line 408 indicates an imaginary line of a slider. The above explained slide fastener and snap fastener should not be limited to a bag, but applicable to any clothes and as such.

REFERENCE SIGNS LIST

100 slide fastener
102 pull tab
104 slider
106 upper stop
108 engaging element (fastener element)
110 lower stop
112 tape member (fastener tape)
114 core thread
116 paper yarn
118 pull tab attaching portion
200 slide fastener
202 pull tab
204 slider
206 upper stop
208 engaging element (fastener element)
210 lower stop
212 tape member (fastener tape)
216 cellulose fiber
218 pull tab attaching portion
300 snap fastener
302 engaging element (female member of snap element)
304 engaging element (male element of snap element)
306 tape member (fastener tape)
400 bag
402 slide fastener
404 slide fastener
410 tape member (fastener tape)
412 engaging element (fastener element)

The invention claimed is:

1. A fastener comprising:

a tape member that includes a first cellulose fiber, wherein said tape member includes paper yarns including 80% by weight of the first cellulose fiber; and an engaging element attached to said tape member, the engaging element including a second cellulose fiber, wherein said engaging element includes 25 to 100% by weight of the second cellulose fiber, 0 to 75% by weight of a polyolefin, and 0 to 30% by weight of starch where the total weight of these three ingredients is equal to or greater than 90% by weight per the weight of said engaging element, wherein a total weight of the first and second cellulose fibers included in said tape member and said engaging element is 51 to 100% by weight per the total weight of said tape member and said engaging element.

2. A fastener comprising:

a tape member that includes a first cellulose fiber, wherein said tape member includes paper yarns including 80% by weight of the first cellulose fiber; and an engaging element attached to said tape member, the engaging element including a second cellulose fiber, wherein said engaging element includes a first blend having no starch, 35 to 70% by weight of the second cellulose fiber, and 30 to 65% by weight of polyolefin, where the total weight of the second cellulose fiber and the polyolefin is equal to or greater than 90% by weight per the weight of said engaging element, or a second blend having no polyolefin, 70 to 90% by weight of the second cellulose fiber and 10 to 30% by weight of starch where the total weight of the second cellulose fiber and the starch is equal to or greater than 90% by weight per the weight of said engaging element, wherein a total weight of the first and second cellulose fibers included in said tape member and said engaging element is 51 to 100% by weight per the total weight of said tape member and said engaging element.

3. The fastener of claim 1, wherein said fastener is a slide fastener comprising a slider that includes 25 to 100% by weight of a third cellulose fiber, 0 to 75% by weight of a polyolefin, and 0 to 30% by weight of starch where the total weight of these three ingredients is equal to or greater than 90% by weight per the weight of said slider.

4. The fastener of claim 2 where said fastener is a slide fastener comprising a slider, wherein said slider includes the same composition as said engaging element.

5. The fastener of claim 2 where said fastener is a slide fastener comprising a slider, wherein said slider includes a different composition than said engaging element.

6. The fastener of claim 3, wherein the total weight of the first, second, and third cellulose fibers included in said tape member, said engaging element and said slider is equal to or greater than 51% by weight per the total weight of said tape member, said engaging element and said slider.

7. The fastener of claim 1, wherein the total weight of the first and second cellulose fibers included in all components of said fastener is equal to or greater than 51% by weight per the total weight of said components of said fastener.

8. An article comprising said fastener of claim 1.

9. A fastener comprising:

a tape member that includes a first cellulose fiber;

an engaging element attached to said tape member, the engaging element including a second cellulose fiber; and a slider that includes 25 to 100% by weight of a third cellulose fiber, 0 to 75% by weight of a polyolefin, and 0 to 30% by weight of starch where the total weight of these three ingredients is equal to or greater than 90% by weight per the weight of said slider, wherein a total weight of the first and second cellulose fibers included in said tape member and said engaging element is 51 to 100% by weight per the total weight of said tape member and said engaging element.

10. The fastener of claim 9, wherein the total weight of the first, second, and third cellulose fibers included in said tape member, said engaging element and said slider is equal to or greater than 51% by weight per the total weight of said tape member, said engaging element and said slider.

* * * * *

UNITED STATES PATENT AND TRADEMARK OFFICE

CERTIFICATE OF CORRECTION

PATENT NO. : 9,179,744 B2
APPLICATION NO. : 13/824480
DATED : November 10, 2015
INVENTOR(S) : Go Takani et al.

It is certified that error appears in the above-identified patent and that said Letters Patent is hereby corrected as shown below:

On the title page, in item (56), in column 2, under "Other Publications", line 2, delete "maiied" and insert -- mailed --, therefor.

IN THE SPECIFICATION

In column 1, line 3, above "Technical Field" insert -- This application is a national stage application of PCT/JP2010/069373 which is incorporated herein by reference. --.

In column 4, line 4, delete "(Kouzo)" and insert -- (Kozo) --, therefor.

In column 6, line 13, delete "(Kouzo)" and insert -- (Kozo) --, therefor.

Signed and Sealed this
First Day of March, 2016

Michelle K. Lee

Michelle K. Lee
*Director of the United States Patent and Trademark Office*